US006676364B1

(12) United States Patent
Hummel et al.

(10) Patent No.: US 6,676,364 B1
(45) **Date of Patent: *Jan. 13, 2004**

(54) STACK CHANGING DEVICE

(75) Inventors: Peter Hummel, Offenbach (DE); Robert Ortner, Alzenau (DE)

(73) Assignee: MAN Roland Druckmaschinen, Offenbach Main (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/367,133

(22) PCT Filed: Feb. 3, 1998

(86) PCT No.: PCT/EP98/00569

§ 371 (c)(1),
(2), (4) Date: Aug. 5, 1999

(87) PCT Pub. No.: WO98/34866

PCT Pub. Date: Aug. 13, 1998

(30) Foreign Application Priority Data

Feb. 5, 1997 (DE) ..... 197 04 285

(51) Int. Cl.[7] ..... B65H 1/26

(52) U.S. Cl. ..... 414/795.8; 271/158; 271/159; 414/802

(58) Field of Search ..... 271/157, 158, 271/159; 414/795.8, 801, 802

(56) References Cited

U.S. PATENT DOCUMENTS

| | | | | | |
|---|---|---|---|---|---|
| 2,690,337 | A | * | 9/1954 | Halahan et al. | 271/159 |
| 4,021,710 | A | * | 5/1977 | Fichte et al. | 271/159 X |
| 4,174,831 | A | * | 11/1979 | Marass et al. | 271/159 |
| 5,011,126 | A | * | 4/1991 | Suzuki et al. | 271/159 X |
| 5,295,681 | A | * | 3/1994 | Blaser | 271/159 X |
| 5,405,130 | A | * | 4/1995 | Maas | 271/159 X |
| 5,538,238 | A | * | 7/1996 | Filsinger | 271/159 |
| 5,803,446 | A | * | 9/1998 | Leuthold et al. | 271/159 X |

FOREIGN PATENT DOCUMENTS

| | | | | |
|---|---|---|---|---|
| DE | 1 095 297 | | 12/1960 | |
| DE | 26 37 086 | * | 12/1977 | 271/159 |
| DE | 39 31 710 A | | 4/1990 | |
| DE | 42 03 500 A | | 8/1993 | |
| EP | 0 604 770 A | | 7/1994 | |
| WO | WO 96/32349 A | | 4/1996 | |

* cited by examiner

*Primary Examiner*—Janice L. Krizek
(74) *Attorney, Agent, or Firm*—Leydig, Voit & Mayer, Ltd.

(57) ABSTRACT

On stack changing, in a sheet feeder, a remaining-stack carrying device (3) is used, of which the remaining-stack bars (7A, 7B) can be pulled in a staggered manner. For better access, a U-shaped mounting (6) is provided, in which the pull drives (11) of the remaining-stack bars (7) are displaceably mounted.

9 Claims, 6 Drawing Sheets

STACK CHANGING DEVICE

FIELD OF THE INVENTION

A The present invention relates to sheet-fed printing machines and, more particularly to an improved stack changing device for sheet feeders of sheet-fed printing machines.

BACKGROUND OF THE INVENTION

It is a known practice, in sheet feeders of sheet printing presses, to provide arrangements for automated stack change. These may consist of rack-type structures, so-called remaining-stack carrying devices, which are provided with thrusting and lifting drives for the horizontal and vertical movement. Such so-called non-stop stack changers are suited, during the printing of paper sheets, i.e. in machine running, to remove stack remainders of worked-out sheet stacks from a pallet provided, for example, with grooves, and to deposit them again on a new sheet stack subsequently installed in the sheet feeder. Known devices are distinguished by high constructive and technical expenditure and require special constructions of the sheet feeders. Further, devices are used of which the remaining-stack carrying device(s) have a rack engaging into the grooves of the pallet. In the unification of the remaining stack with newly installed main stack, this rack has to be removed as a whole between the two stack parts. This involves high drive forces and places great strain on the next-lying sheets of the stack. Furthermore, retaining means are to be provided that prevent a shifting of the stack parts, and, in so doing strongly stress the stack edges. Furthermore, the operation of the sheet feeder itself is severely hampered or even made impossible. The sheet flow is difficult to control in the changing process, so that waste sheets result again and again.

Devices have already been developed that avoid in part some of the disadvantages described.

Thus, from DE 393 1710 C2 there is known a nonstop sheet feeder for rotary sheet-fed machines. It has a remaining-stack carrying device which is arranged underneath a conveyor table leading from the sheet feeder to the sheet-fed rotary machine. The remaining-stack carrying device has a closed frame on which there are arranged nonstop rods which can be driven as piston rods of individual cylinders by means of a pressure medium, and which are drivable into grooves of a pallet carrying a sheet stack. The nonstop rods lie, in the driven-in state, on both sides of the frame and are to be removed in succession out of the range of the sheet feeder. While the rods have individual drive cylinders, the patent discloses nothing about the sequence of operation. The arrangement under the sheet feeding table is unsuitable for practical operation.

A sheet feeder is known From DE 4 203 500 A1. It has, parallel to the sheet feeder and allocated to this on the face side, a remaining-stack carrying device as an independent component. Then, over a common drive, there are provided individually drivable pointed bars which are drivable into grooves of a pallet carrying a sheet stack. The drive has individual chain gears which are couplable to the respective pointed bars. For the guiding and accessibility of the chain gears, special constructive measures are required. The chain gears completely block the space in front of the sheet feeder, so that the latter is not accessible. Further, from DAS 1095297 there is known a sheet feeder with several stack-lifting mechanisms. This feeder has a fork-shaped remaining-stack carrying device which is provided with remaining-stack bars slidable into grooves of a pallet. The device makes possible the taking over of a remainder of a sheet stack from the pallet, for the continuous feeding-in of the sheets while a new sheet stack is installed into the sheet feeder. The remaining-stack lifting mechanism is connected with a separate lifting mechanism parallel to the main lifting mechanism within the sheet feeder, so that the remaining stack is continuously liftable. The operating range of the remaining-stack carrying device is very severely restricted by the lever arrangement, so that only short time intervals are available for the stack changing. The remaining-stack carrying device hampers access to the sheet feeder, since it has to be placed outside of the sheet feeder as long it is needed.

OBJECTS AND SUMMARY OF THE INVENTION

In view of the foregoing, an object of the present invention is to provide an improved stack changing device which overcomes the problems associated with prior art designs.

A more specific object of the present invention is to provide a stack changing device which allows for simple, continuous and efficient stack changing along with improved operational parameters.

The present invention provides these and other advantages and overcomes the drawbacks of the prior art by providing a stack changing device which utilizes an improved method and device for receiving a remaining-stack and transferring the remaining stack to a newly fed-in sheet stack.

It is advantageous that carrying and spacing bars movable independently from one another are provided in the device, which are pulled out of the stack zone not simultaneously but intermittently for the unburdening of the sheet material. The arrangement of the remaining-stack bars in a remaining-stack carrying device of the type described makes possible access to the operating zone also during the changing process. Specifically, an operating space is kept free in the zone of the bar guidance during the stack changing.

Through the fact that the remaining-stack bars are formed of different length according to type, there results an improved working process. In the changing operation, in particular, the time for the sliding-in and pulling-out of the remaining-stack bars can be reduced by the means that the remaining-stack bars are already driven into a waiting position before the changing, and are slid in completely only at the beginning of the changing process.

These and other features and advantages of the invention will be more readily apparent upon reading the following description of preferred exemplary embodiments of the invention and upon reference to the drawings wherein:

While the invention will be described and disclosed in connection with certain preferred embodiments and procedures, it is not intended to limit the invention to those embodiments. Rather it is intended to cover all such alternative embodiments and modifications as fall within the spirit and scope of the invention.

DETAILED DESCRIPTION OF PREFERRED EMBODIMENTS

Figure 1:
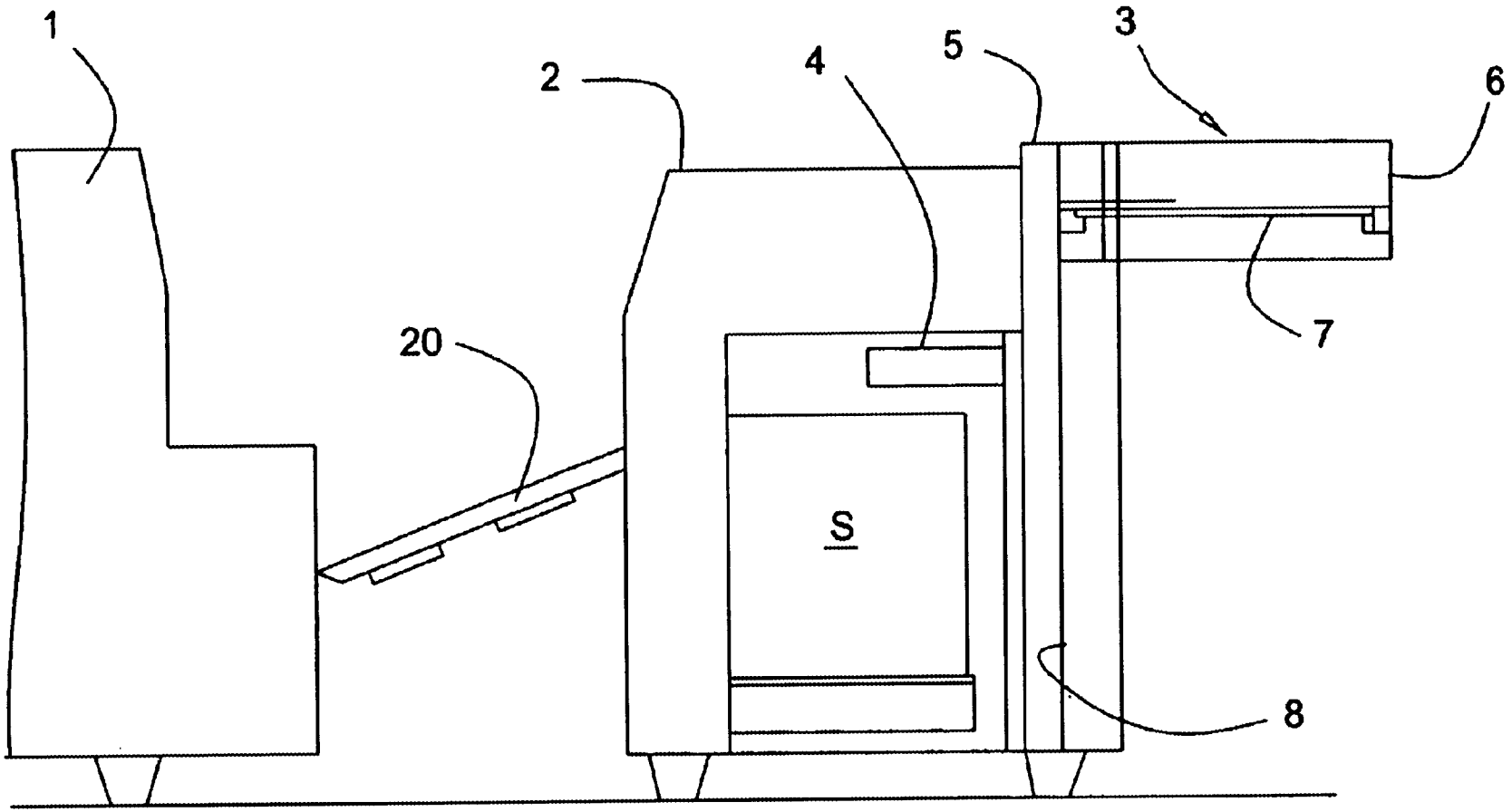
FIG. 1 is a side elevation view of an illustrative embodiment of a sheet feeder constructed in accordance with the present invention.

In FIG. 1, a sheet feeder 2 is shown connected with a sheet-processing machine, for example with a printing press 1. In the sheet feeder 2 there is installed a sheet stack S for processing. The sheet stack S can be raised in the rhythm of the sheet processing, by means of a main-stack lifting mechanism which is not represented in detail here.

The sheets of the stack S are singled on its upper side and fed to the sheet-fed printing press 1 as a sheet stream. In the sheet feeder 2 there is provided a sheet-singling arrangement which is provided with a considerable number of multiple operating elements for format-dependent adjustments and for adjustments of the supplying of either suction or blast air. The operating elements serve for the attuning of the various functions of the sheet-singling device 4 for the proper transport of the sheets from the sheet feeder 2 to the sheet printing press 1. Here, inter alia, the singling process itself is also influenced as well as the transfer of the sheets from the sheet feeder 2 to further-leading sheet transport arrangements.

In the sheet feeder 2 there is arranged, further, a remaining-stack carrying device 3, which is allocated to the face side away from the sheet-fed printing press 1 of the sheet feeder 2. The remaining-stack carrying device 3 is provided with a frame 6, in which the remaining-stack bars 7 are longitudinally slidably borne. By means of the frame 6 the remaining-stack carrying device 3 is suspended on a remaining-stack mechanism 5. Only the position of the remaining-stack lifting mechanism 5 is shown here, but not any of its details. It ordinarily contains two pairs of lift chains which are drivable from the sheet feeder 2. The remaining-stack lifting unit 5 serves to hold a remaining stack H in the sheet feeder 2, and to raise it in the rhythm of the sheet processing. For this reason the remaining-stack lifting mechanism 5 is also controllable synchronously with the main stack-lifting mechanism. The remaining-stack lifting mechanism consists, further, of vertical guide rails 8 connected with the sheet feeder 2, on which (rails) the frame 6 is guided, and is raisable or lowerable by means of the lift chains.

Figure 2:
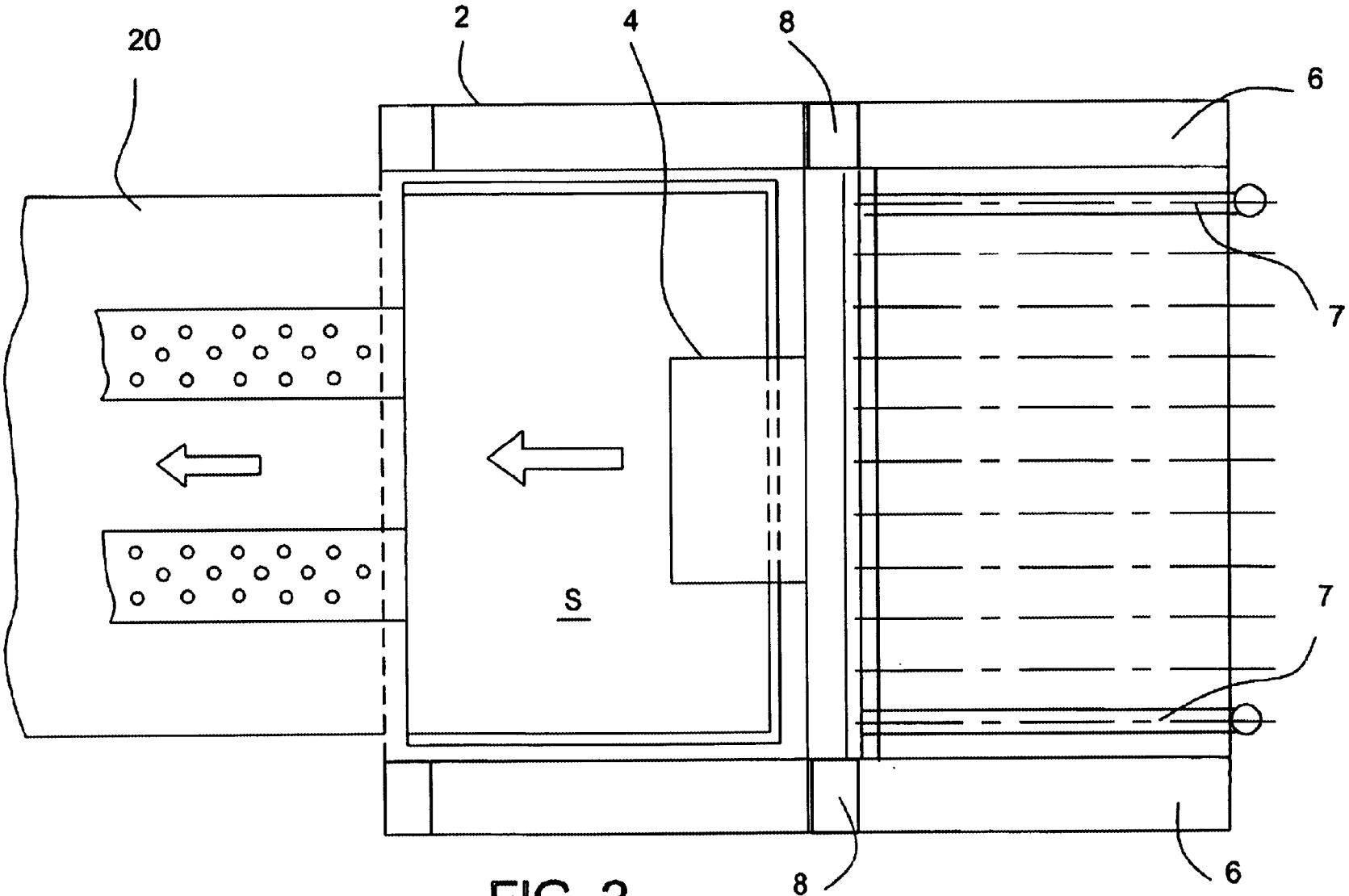
FIG. 2 is a plan view of sheet feeder.

In FIG. 2, the sheet feeder 2 is shown in a top view. On the sheet feeder 2 there follows in the sheet running direction indicated by arrows, a so-called conveyor table 20, over which the sheet stream generated by the singling is transported to the sheet processing machine, for example the printing press 1. Further, the position of the sheet singling device 4 is recognizable in allocation to the rear edge of the sheet stack S. The orientation of the remaining-stack bars 7 is represented in its arrangement of these bars in respect to the sheet feeder 2, only the two outer remaining-stack bars 7 being represented, and the others being indicated with effect lines. The position shown is, for example, the readiness position before the initiation of a changing process, or the waiting position outside of the operating zone of the sheet feeder 2. The remaining-stack bars 7 are led there inside the remaining-stack carrying device 3, so that in the position shown they occupy a horizontal position outside the range of the sheet feeder 2. The remaining-stack carrying device 3 with its frame 6 is guided by means of the guide rails 8 and it is vertically movable. The remaining-stack lifting mechanism 5 again is indicated only in its position with respect to the remaining-stack carrying device 3, and it is located in the sheet feeder 2 as well as on the upper side of the guide rails 8, for example on the frame of the sheet feeder 2, from thereon it grips the frame 6 of the remaining-stack carrying device 3 and moves the latter upward and downward on the guide rails 8.

Figure 3:
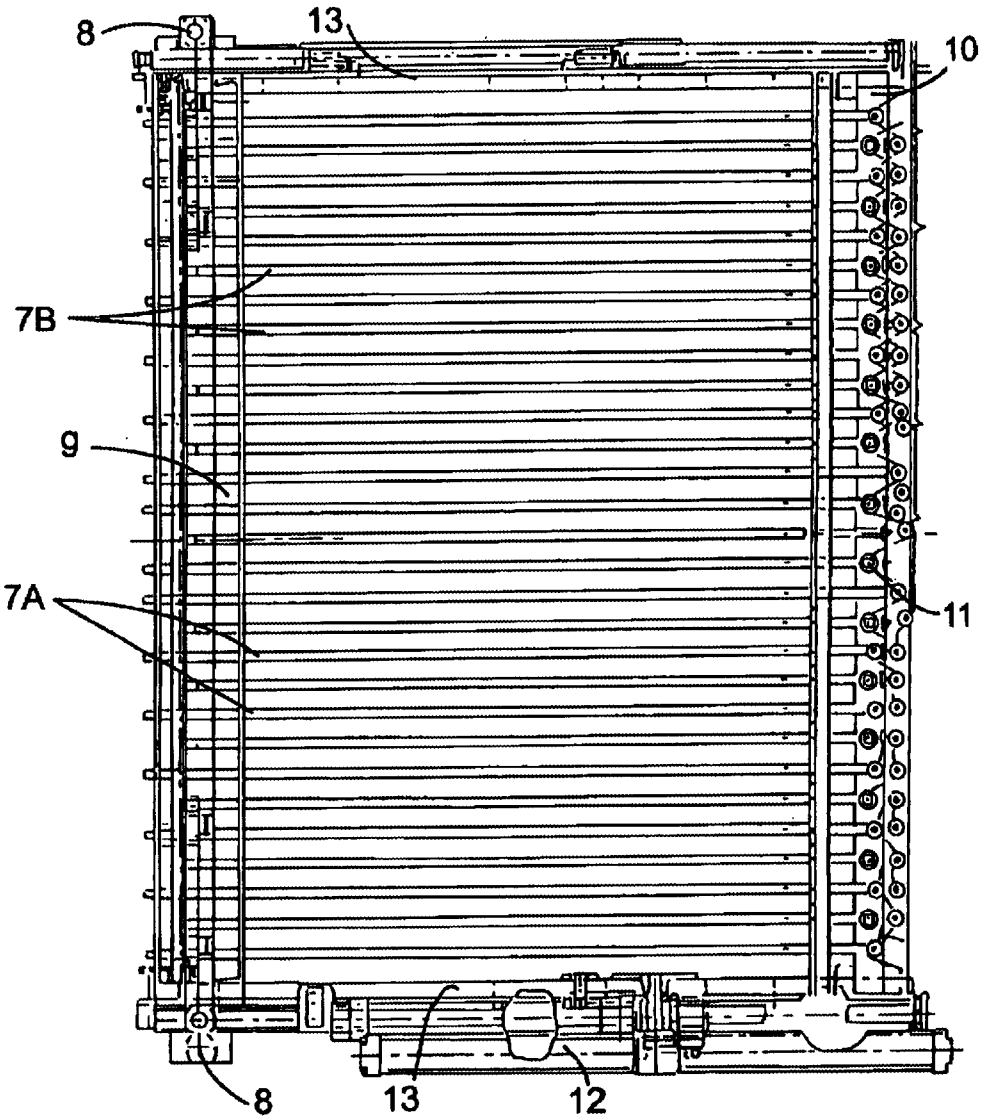
FIG. 3 is a plan view of a stack-changing device of the sheet feeder of FIG. 1.
Figure 3:
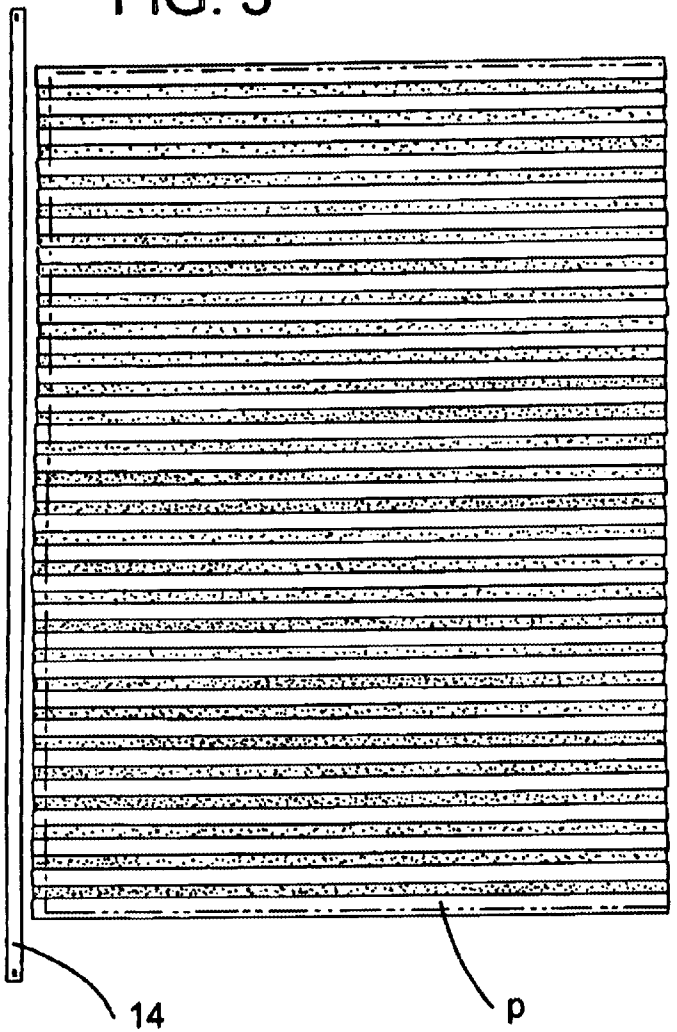

In FIG. 3, there is shown a complete representation of the remaining-stack carrying device 3. The frame 6 is U-shaped and guided vertically on the guide rails 8. In the frame 6, on a front carrying rail 9 there are guided the remaining-stack bars 7 in the form of carrying bars 7A and spacer bars 7B. It will be appreciated by one skilled in the art that various known pulling drives may be used for individually pulling the carrying bars 7A and spacing bars 7B including gear drive chains such as shown in the above-referenced DE 4203 500 A1 or individual drive cylinders, such as shown in the above-referenced DE 39 171 0 C. Moreover, as will become apparent herein, such known drives may be operated to simultaneously pull more than one carrying bar 7A or spacing bar 7B at a time. On a rear carrying rail 10 there is arranged a drive 11 for the singled pulling-out or sliding-in of the carrying bars 7A and spacing bars 7B. The position shown is the waiting position. Further, drives 12 are provided on both sides for the longitudinal shifting of the rear carrying rail 10 on guide rails 13 on the side parts of frame 6. The drive means 12 determine the position of the rear carrying rail 10 inside the frame 6. The front carrying rail 9 is firmly joined with the frame 6.

The carrying bars 7A and the spacing bars 7B may be of equal length. In a preferred form of execution, the carrying bars 7A, however, are longer than the spacing. bars 7B. The carrying bars 7A serve, in the takeover of a remaining-stack H, first of all for the load reception, and they are to be dimensioned correspondingly, in which case the load is to be led off into a further carrying means (see FIG. 4)

Figure 4:
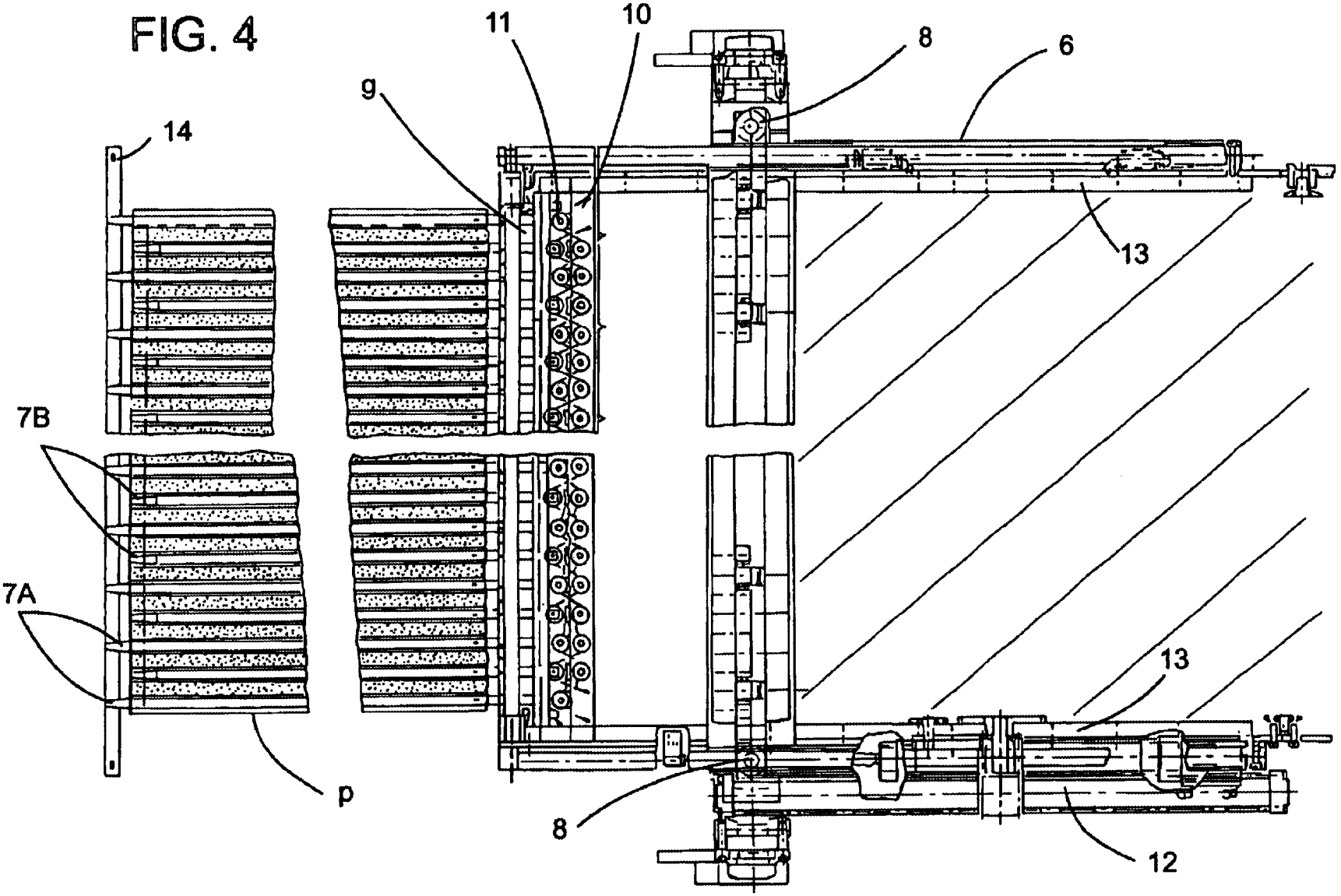
FIG. 4 is a plan view showing the stack-changing device of FIG. 3 taking over remaining stack.

In FIG. 4, the remaining-stack carrying device 3 is shown in operation. The carrying bars 7A as well as the spacing bars 7B are thrust forward by means of their individual drives, or for example by means of the drives 12, together with the rear carrying rail 10, with respect to the front carrying rail 9 and they are introduced into grooves of a pallet P that carries the sheet stack S. Front carrying rail 9 and rear carrying rail 10 with the pulling drive 11, now lie parallel in front of the pallet P, which carries a remaining stack H remaining from the sheet stack S. The pallet P and the remaining stack H are not in contact with the front carrying rail 9. The longer and higher carrying bars 7A lie on a remaining-stack lifting rail 14 on the front end in the sheet feeder 2 (as seen in the sheet running direction). This remaining-stack lifting rail 14 is coupled with a lifting drive and provides for the support of the carrying bars 7A as well as their lifting movement during production. The remaining-stack lifting rail 14 and the remaining-stack lifting unit 5 are both connected for this purpose with the main stack lifting unit of the sheet feeder 2, or at least mechanically or controllably coupled with one another in such manner that in the stack processing, especially in the bringing-together of the remaining-stack H and of a new sheet stack S, they can be synchronously lifted.

In FIG. 4 a first very important aspect of the invention is shown. In the illustrated position of the remaining-stack carrying device 3 with carrying bars 7A and the spacing bars 7B slid in the pallet P, the space inside the frame 6 is completely free. This is produced through the fact that the frame 6 of the remaining-stack carrying device 3 is constructed in U-shape form. Further, guide elements for the remaining-stack bars 7 are slidable inside frame 6. The carrying rail 10 is slidable in common with the remaining-stack bars 7. Alternatively, the carrying rail 10 is arranged in a thrust-forward position inside the frame 6. The remaining-stack bars 7 are then thrust forward on the carrying rail 10 by individual drive means. In both cases, the area shown shaded in FIG. 4 is kept free and thereby accessible. This area is also protected, since security measures, not described in detail here, are provided, which prevent a movement of the remaining-stack carrying device 3 or of the rear carrying rail 10 within the frame 6 when the operator is present in the zone mentioned, for example to adjust the feeder 2. These, however, are not an object of the present invention.

Figure 5:
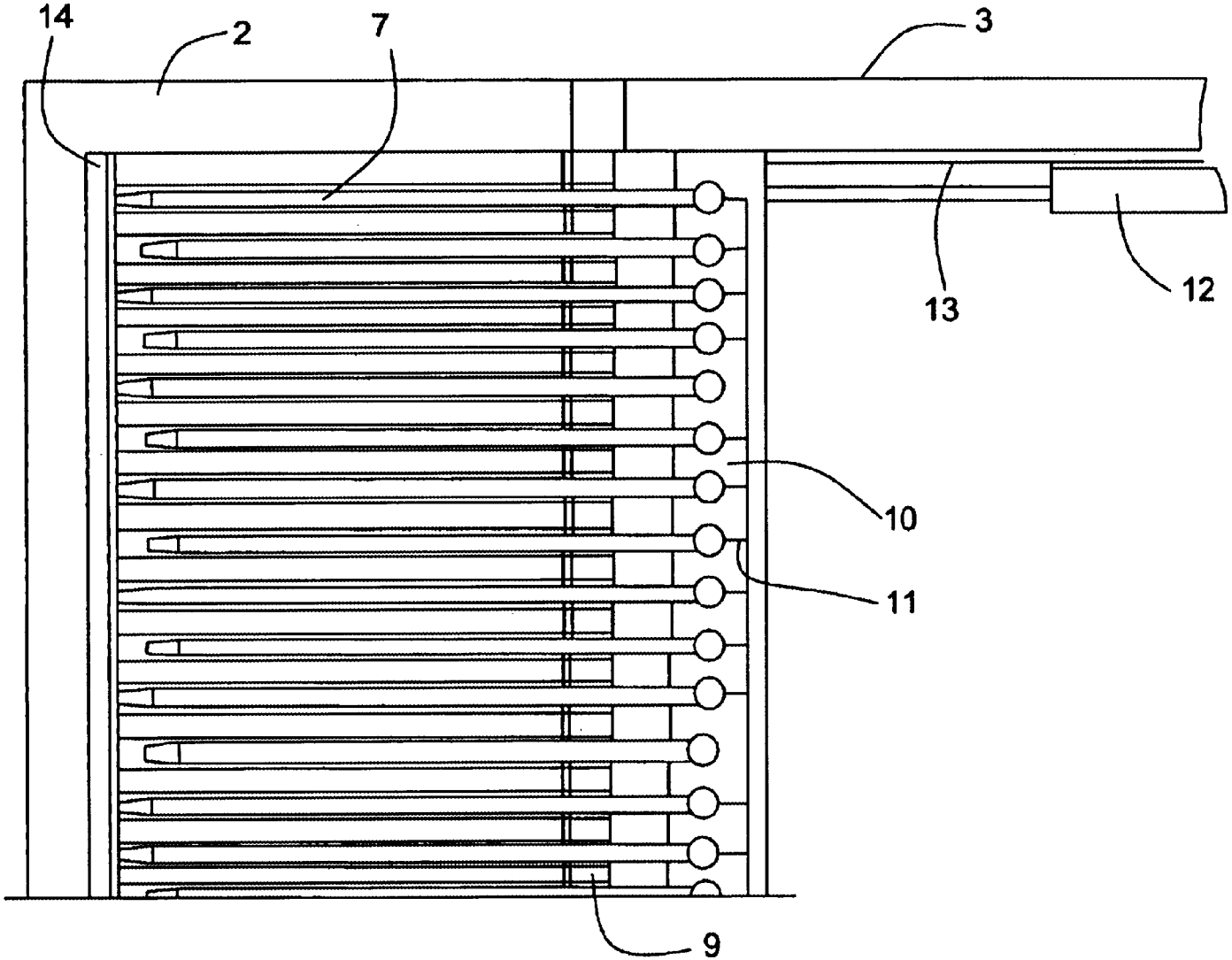
FIG. 5 is an enlarged partial plan view showing a first position of the remaining-stack bars and FIG. 6 is an enlarged partial plan view showing a second position of the remaining-stack bars during the stack changing process.
Figure 6:
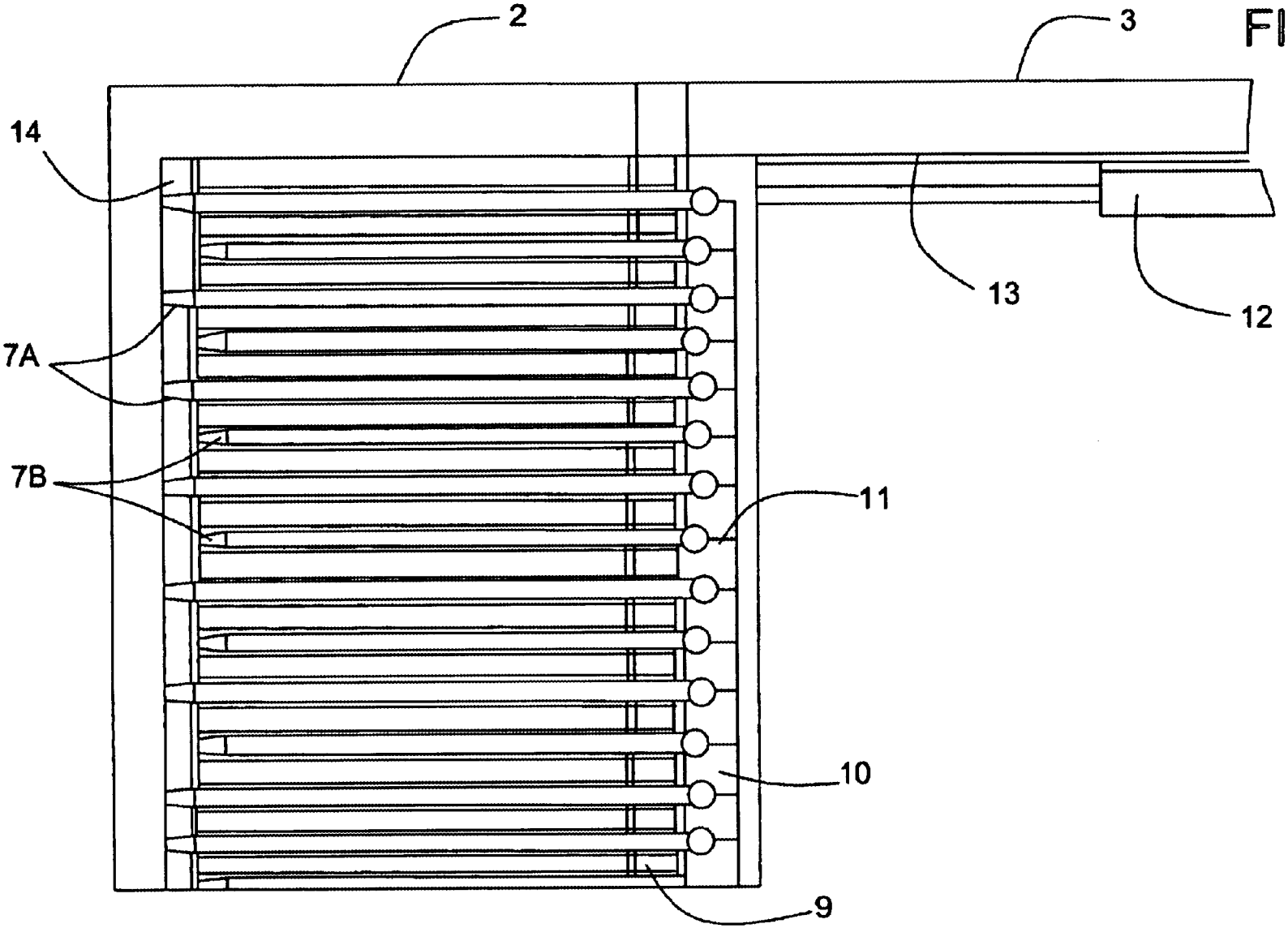

In this case, it is of importance for the handling that the carrying bars 7A and spacing 7B are slid into the grooves of the pallet P early, i.e., long before the actual required changing operation process. During production time, the space in the zone of the stack changer is therefore always free. For the case in which the carrying bars 7A and the spacing bars 7B are already slidable early into the grooves of the pallet P, i.e. long before the actually required changing process, provisions are made on the stack changer. The remaining-stack carrying device 3 is raisable and lowerable over the entire height of the sheet feeder 2 by means of the remaining-stack lifting mechanism 5. The remaining-stack carrying device 3, therefore, can be raised in common with the sheet stack S, even when the stack changing process is not yet to occur. The remaining-stack lifting rail 14, however, is arranged in a usual manner in a position corresponding to a minimally admissible height of the remaining stack H before the start of the stack changing process, from where it is liftable. It lies for example in a vertical guide on stops and can be lifted off from there by means of the remaining-stack lifting mechanism. For this reason the remaining-stack bars 7, when they are already driven underneath the height position of the remaining-stack lifting rail 14, are at first slid only into a waiting position. For this, drive means are provided which act individually on each one of the remaining-stack bars 7. From FIG. 5 it is shown that the rear carrying rail 10 is brought to a standstill with a spacing from the front carrying rail 9. The remaining-stack bars 7, at least however the carrying bars 7A, then stand with their front end in a collision-free position to the remaining-stack lifting rail 14. This position can agree, for example, with the front edge of the pallet P allocated to the bar ends. This position is retained until the stack changing operation actually must occur. Then, in correspondence to FIG. 6, at least the carrying bars 7A are driven over the remaining short distance up to the covering-over with remaining-stack lifting rail 14. For this, second drive means are provided which act on all the remaining-stack bars 7 in common. For example, the rear carrying rail 10 is thrust into forward position, in common with the remaining-stack bars 7, over the remaining distance up to the driven-in end position of these remaining-stack bars 7. Then the remaining stack still has to be finally deposited only by a lowering of the pallet P onto the remaining-stack bars 7. When the remaining-stack bars 7 are pulled out again, i.e., when the stack joining has occurred, the remaining-stack bars 7 preferably are immediately driven again into their waiting position in the grooves of the pallet P with a new sheet stack S.

For the execution of the described run-off, essentially two drive means are required.

A first drive means can be constructed as a drive for all the remaining-stack bars in common, or as an individual drive for each of the remaining-stack bars 7, and it acts only up to the waiting position.

A second drive acts on all the remaining-stack bars 7 in common and thrusts these out of the waiting position and into the slid-in position.

In a first form of execution of the invention, the remaining stack bars 7 can be led individually drivably on the rear carrying rail 10, in which arrangement the rear carrying rail 10 is then arranged permanently in a position near the front carrying rail 9.

In a second form of execution, the remaining-stack bars 7 can be thrust forward in common over the length of the frame 6 from the rear carrying rail 10 into the waiting position, where, however, they can be separated from the rear carrying rail 10.

For achieving the slid-in end position, the rear carrying rail 10 is in both cases additionally slidable. It is, for example, by means of the drive 11, still slidable forward over the remaining distance between the waiting position and the slid-in end position.

Moreover, sensors can be provided, by means of which the remaining-stack bars 7 are positionable, regardless of the height position of the new sheet stack S, into a position for threading into the grooves of the pallet P. For this, for example, a light-barrier arrangement is suitable, which trans-illuminates a groove of the pallet P. This arrangement can be provided with a sensor on the remaining-stack lifting mechanism 5, in such manner that the remaining-stack carrying device 3 is automatically fittable to the thus found correct height position. Then the remaining-stack bars 7, also are slidable into the grooves of the pallet P. Further, in regard to the height position of the remaining-stack lifting rail 14, sensors can be provided which avoid the overstepping of the upper edge of the remaining-stack lifting rail 14 by the remaining-stack bars 7. By way of these sensors, the controllers of the drive means of the remaining-stack bars 7 are connected in such manner that the latter, on a signal of the sensors, are slidable over the remaining distance, into the slid-in final position above the remaining-stack lifting rail 14. Preferably, this takes place by the means that all the remaining-stack bars 7 are slidable in common with the rear carrying rail 10, out of the waiting position into the end position. In the above-described device, the remaining-stack lifting rail 14 is carried along, out from its support in a lower waiting position, simply by the remaining-stack carrying device 3, using the remaining-stack lifting mechanism 5. The remaining-stack bars 7 thus can be already thrust forward into their slid-in end position, as soon as the coupling-in of the remaining-stack lifting rail 14 with the remaining-stack carrying device 3 has taken place.

The stack change proceeds, therefore, as follows:

I. Lowering of the remaining-stack carrying device 3 to the lower edge of the sheet stack S during the raising by the main-stack lifting mechanism.

II. Scanning of the pallet P for the position of the grooves, positioning of the remaining-stack carrying device 3 for the driving-in of the remaining-stack bars 7.

III. Sliding-in of the carrying bars 7A and spacing bars 7B in common, in the grooves of the pallet P under the sheet stack S, into waiting position.

IV. Synchronous raising of the remaining-stack carrying device 3 and of the sheet stack S until the remaining-stack bars 7 pass the remaining-stack lifting rail 14 collision-free.

V. Scanning of the position of the remaining-stack lifting rail 14 with respect to the remaining-stack bars 7.

VI. Final driving-in of the remaining-stack bars 7 into their slid-in end position above the remaining-stack lifting rail 14.

VII. Undercutting of the carrying bars 7A with the remaining-stack lifting rail 14 and raising until the remaining-stack H is carried by the carrying bars 7A.

VIII. Lowering of the pallet P and removing it from the sheet feeder 2.

IX. Raising of the remaining stack H with remaining-stack mechanism 5 for the sheet singling.

X. Installing of the sheet stack S into the sheet feeder 2 and raising it.

XI. On contact of the sheet stack S with the underside of the carrying bars 7A, the pulling out of all the remaining-stack bars 7, in staggered positions and from inside outward, until the remaining-stack H rests on the new sheet stack S.

XII. Lowering of the remaining-stack carrying device 3 to the lower edge of the sheet stack S during its liftable movement onto the main-stack lifting mechanism.

By means of this runoff, it is ensured that no time must elapse for unnecessary lifting distance, which (time) then is not available for the changing process. This is especially of great importance in the case of thick sheet materials with correspondingly more rapid using up of the sheet stack S at high machine velocities.

What is claimed is:

1. A process for automatically and continuously changing a sheet stack in a sheet feeder of a sheet-processing machine including a main stack lifting mechanism and a remaining-stack carrying device having a plurality of parallel remaining-stack bars and a remaining-stack lifting rail disposed in transverse relation to said parallel remaining-stack bars, the stack changing process comprising the steps of:

sliding the remaining-stack bars horizontally to a first waiting position wherein the remaining-stack bars are arranged in a stack zone in grooves of a pallet underneath a first sheet stack prior to the first sheet stack reaching a minimal height whereupon it is converted to a remaining-stack, lifting the remaining-stack bars synchronously with the main stack lifting mechanism after the first stack is converted to a remaining-stack such that the remaining-stack bars are moved vertically past the level of said remaining-stack lifting rail without horizontally moving said remaining-stack lifting rail until a lower edge of the remaining-stack bars is arranged at least at a level corresponding to an upper edge of the remaining-stack lifting rail, sliding the remaining-stack bars horizontally into a second final slid-in stack position wherein at least a portion of the remaining-stack bars overlies the remaining-stack lifting rail, raising the remaining-stack by raising the remaining-stack bars with the remaining-stack lifting rail while the pallet is lowered by the main stack lifting mechanism, and depositing said remaining-stack on a newly fed-in second sheet stack which has been moved by the main stack lifting mechanism into position below said remaining-stack by removing the remaining-stack bars from the remaining-stack.

2. A device for changing a sheet stack in a sheet feeder of a sheet processing machine comprising:

a main stack lifting mechanism for raising and lowering a sheet stack, a remaining-stack carrying device including a plurality of parallel remaining-stack bars for temporarily receiving a remaining-stack and transferring said remaining-stack to a newly fed-in sheet stack, said remaining-stack bars being mounted for horizontal and vertical movement, said remaining-stack carrying device including a lifting rail disposed in transverse relation to said parallel remaining-stack bars, said lifting rail being mounted for only vertical movement, a horizontal drive mechanism for horizontally moving the remaining-stack bars to a first position in a stack, a vertical drive mechanism operable for vertically raising the remaining-stack bars and a remaining-stack positioned thereon to a position above the level of the remaining-stack lifting rail without horizontal movement of the remaining-stack lifting rail, said horizontal drive mechanism further being operable for horizontally moving the remaining-stack bars from said first position to a second position wherein at least a portion of some of said remaining-stack bars overlies the remaining-stack lifting rail, and said vertical drive mechanism being operable for raising the remaining-stack lifting rail, remaining-stack bars, and remaining-stack vertically with said at least a portion of some of the remaining-stack bars overlying the remaining-stack lifting rail.

3. A device for changing a sheet stack in a sheet feeder of a sheet processing machine, the sheet stack having two opposing edges and a middle area interposed between the edges, the stack changing device comprising:

a main stack lifting mechanism for raising and lowering a sheet stack on a pallet having grooves, a remaining-stack carrying device including a plurality of parallel remaining-stack bars for temporarily receiving a remaining-stack and transferring said remaining-stack to a newly fed-in sheet stack, said remaining-stack carrying device having a U-shaped frame mounted rearwardly of the sheet feeder in relation to a sheet feed direction, said U-shaped frame having a pair of transversely spaced side frame members parallel to said remaining-stack bars and a transverse front carrying rail that defines a closed end of said frame adjacent the sheet feeder, said U-shaped frame having an open end on a side facing away from the sheet feeder, said remaining-stack carrying device further including a rear carrying rail mounted for movement with said remaining-stack bars within said U-shaped frame, a drive mechanism for slidably moving said rear carrying rail and remaining-stack bars longitudinally into a stack position with said remaining-stack bars positioned in the grooves of the pallet and said rear carrying rail positioned adjacent said front carrying rail with said open end of the U-shaped frame being substantially unobstructed, and said drive mechanism being operable for moving said rear carrying rail and the remaining-stack bars from the stacking position into a stored position between said side frame members, and a remaining-stack lifting mechanism for raising the remaining-stack carrying device.

4. The stack changing device according to claim 3 wherein the remaining-stack bars have one of two different respective thicknesses and lengths.

5. The stack changing device according to claim 3 wherein each of the remaining-stack bars have one of two different relative thicknesses and the remaining-stack bars are arranged in a symmetrical arrangement alternating between the two relative thicknesses over the width of the remaining-stack carrying device.

6. The stack changing device according to claim 3 wherein said remaining-stack bars include first remaining-stack bars having one length and thickness and second remaining-stack bars having a length and thickness different from the length and thickness of said first remaining-stack bars, and said first and second stack bars are in an alternating arrangement over the width of the remaining-stack carrying device.

7. The stack changing device according to claim 3 wherein the remaining-stack bars comprise carrying bars and spacing bars with the carrying bars being relatively thicker than the spacing bars.

8. The stack changing device according to claim 3 wherein the remaining-stack bars comprise carrying bars and spacing bars, with the carrying bars being relatively longer than the spacing bars.

9. The stack changing device according to claim 3 in which said remaining-stack carrying device includes a stack lifting rail disposed on a side of the sheet feeder opposite said rear carrying rail, said drive mechanism being operable for horizontally moving said remaining-stack bars to said stack position with ends of at least some of said remaining-stack bars positioned over said stack lifting rail, and said remaining-stack lifting mechanism being operable for simultaneously lifting said stack lifting rail, frame, remaining-stack bars, and rear carrying rail.

* * * * *